US008162426B2

(12) United States Patent
Suzuki

(10) Patent No.: US 8,162,426 B2
(45) Date of Patent: Apr. 24, 2012

(54) RECORDING APPARATUS

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 398 days.

(21) Appl. No.: 12/549,278

(22) Filed: Aug. 27, 2009

(65) Prior Publication Data

US 2010/0053238 A1 Mar. 4, 2010

(30) Foreign Application Priority Data

Aug. 28, 2008 (JP) ..... 2008-219321

(51) Int. Cl.
*B41J 29/38* (2006.01)

(52) U.S. Cl. ..... 347/11; 347/5; 347/10

(58) Field of Classification Search ..... None
See application file for complete search history.

(56) References Cited

U.S. PATENT DOCUMENTS 6,312,077 B1 * 11/2001 Araki ..... 347/11
6,802,584 B2 10/2004 Kageyama
6,908,167 B2 * 6/2005 Kitami et al. ..... 347/11
7,347,519 B2 3/2008 Nagamura et al.
2005/0219282 A1 10/2005 Kachi
2007/0263036 A1 11/2007 Ito

FOREIGN PATENT DOCUMENTS

JP H07-256931 A 10/1995
JP 2002-316423 A 10/2002
JP 2005-193598 A 7/2005
JP 2005-280246 A 10/2005
JP 2006-007759 A 1/2006
JP 2007-301844 A 11/2007

* cited by examiner

*Primary Examiner* — Lam S Nguyen
(74) *Attorney, Agent, or Firm* — Baker Botts L.L.P.

(57) ABSTRACT

A recording apparatus includes a calculator, a predictor, and a head controller. Assuming that first ejection signals are supplied to a recording head, the calculator calculates variations in total amount of liquid to be ejected, for respective constant periods of time. The predictor predicts, based on one or more calculated variations, whether a pressure difference between the atmosphere and liquid falls below a threshold value, the atmosphere and the liquid sandwiching a meniscus formed in one of the ejection openings. When the predictor predicts that the pressure difference falls below the threshold value, the head controller controls signal supply to the recording head so that second ejection signals are supplied to the recording head, the second ejection signals having a lower frequency than first ejection signals.

11 Claims, 15 Drawing Sheets

VARIATION ΔV V1,V1−V2,0 ----------

RECORDING APPARATUS

CROSS REFERENCE TO RELATED APPLICATION

The present application claims priority from Japanese Patent Application No. 2008-219321, which was filed on Aug. 28, 2008, the disclosure of which is herein incorporated by reference in its entirety.

BACKGROUND OF THE INVENTION

1. Field of the Invention

The present invention relates to a recording apparatus which ejects a liquid droplet to record an image on a recording medium.

2. Description of the Related Art

An inkjet printer is known, which ejects an ink droplet toward a recording medium such as a recording sheet, to record an image thereon. An inkjet head incorporated into the printer includes a common ink passage where ink from an ink tank is supplied, and a plurality of individual ink passages each of which starts from an exit of the common ink passage and reaches an ejection opening through which an ink droplet is ejected towards a recording medium.

SUMMARY OF THE INVENTION

When a plurality of ejection openings simultaneously eject ink droplets in the above inkjet head, shortage of ink supply may occur due to a passage resistance and an inertial force caused by an ink mass. This causes a great negative pressure to be generated in the common ink passage, which causes a meniscus formed in one of the ejection openings not ejecting an ink droplet to be prone to breakage, which meniscus is a border between ink and the atmosphere. A broken meniscus leads to abnormal ejection of an ink droplet through the ejection opening. Thus, a conceivable approach to overcoming the shortage of ink supply to the individual ink passages is to enlarge cross-sectional areas of the passages in order to reduce the passage resistance in the common ink chamber. Enlarged cross-sectional areas of the common ink passage, however, leads to a large inkjet head.

An object of the present invention is to provide a recording apparatus which is capable of preventing a meniscus formed in an ejection opening from breaking while realizing a smaller recording head.

A recording apparatus according to one aspect of the present invention includes: a recording head; a movement mechanism; a storage; a first ejection signal generator; a calculator; a predictor; a second ejection signal generator; a head controller; and a movement controller. The recording head is provided with a plurality of ejection openings each of which ejects a liquid droplet. The movement mechanism moves a recording medium relative to the recording head. The storage stores therein drive data which indicates an amount of liquid to be ejected in each recording cycle through each of the ejection openings. The first ejection signal generator generates first ejection signals each having a first frequency, based on the drive data stored in the storage. The calculator calculates, for respective constant periods of time, variations in total amount of liquid to be ejected through the plurality of ejection openings, assuming that first ejection signals are supplied to the recording head. Based on one or more of the variations calculated by the calculator, the predictor predicts whether a pressure difference between the atmosphere and liquid falls below a threshold value during recording to a recording medium by the recording head to which the first ejection signals are supplied, the atmosphere and the liquid sandwiching a meniscus formed in one of the ejection openings. The second ejection signal generator generates second ejection signals each having a second frequency lower than the first frequency, based on the drive data stored in the storage. The head controller controls signal supply to the recording head so that first ejection signals are supplied to the recording head when the predictor predicts that the pressure difference does not fall below the threshold value, and second ejection signals are supplied to the recording head when the predictor predicts that the pressure difference falls below the threshold value. The movement controller controls the movement mechanism so that a recording medium moves relative to the recording head at a speed corresponding to one of a first ejection signal and a second ejection signal, the one signal being supplied to the recording head.

A recording apparatus according to another aspect of the present invention includes: a conveyance mechanism; a recording head; a storage; an ejection signal generator; a carriage; a conveyance controller; a carriage controller; an ejection controller; a calculator; and a predictor. The conveyance mechanism conveys a recording medium in a conveyance direction. The recording head is a serial recording head provided with a plurality of ejection openings each ejecting a liquid droplet. The storage stores therein drive data which indicates an amount of liquid to be ejected in each recording cycle through each of the ejection openings. The ejection signal generator generates ejection signals each having a predetermined frequency, based on the drive data stored in the storage. The carriage which moves the recording head forward and backward in a direction perpendicular to the conveyance direction. The conveyance controller which controls the conveyance mechanism so that a recording medium is conveyed in the conveyance direction by a predetermined distance at a time. The carriage controller controls forward and backward movements of the carriage in such a manner that a stopping time of the recording head is variable, which stopping time is after the recording head finishes taking at least one of a forward movement and a backward movement before starting a movement in the opposite direction. The ejection controller controls supply of ejection signals to the recording head, so that liquid droplets are ejected through the ejection openings towards a recording medium paused during its conveyance by the conveyance mechanism. Assuming that the ejection signals are supplied to the recording head, and the stopping time is a predetermined period of time, the calculator calculates variations in total amount of liquid to be ejected through the ejection openings for respective constant periods of time each longer than a time necessary for the carriage to move the recording head forward or backward. Based on one or more of the variations calculated by the calculator, the predictor predicts whether a pressure difference between the atmosphere and liquid falls below a threshold value, the atmosphere and the liquid sandwiching a meniscus formed in an ejection opening during printing on a recording medium by the recording head to which the ejection signals are supplied. When the predictor predicts that the pressure difference does not fall below the threshold value, the carriage controller controls the carriage so that the stopping time is the predetermined period of time. Meanwhile, when the predictor predicts that the pressure difference falls below the threshold value, the carriage controller controls the carriage so that the stopping time is longer than the predetermined period of time.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Figure 1:
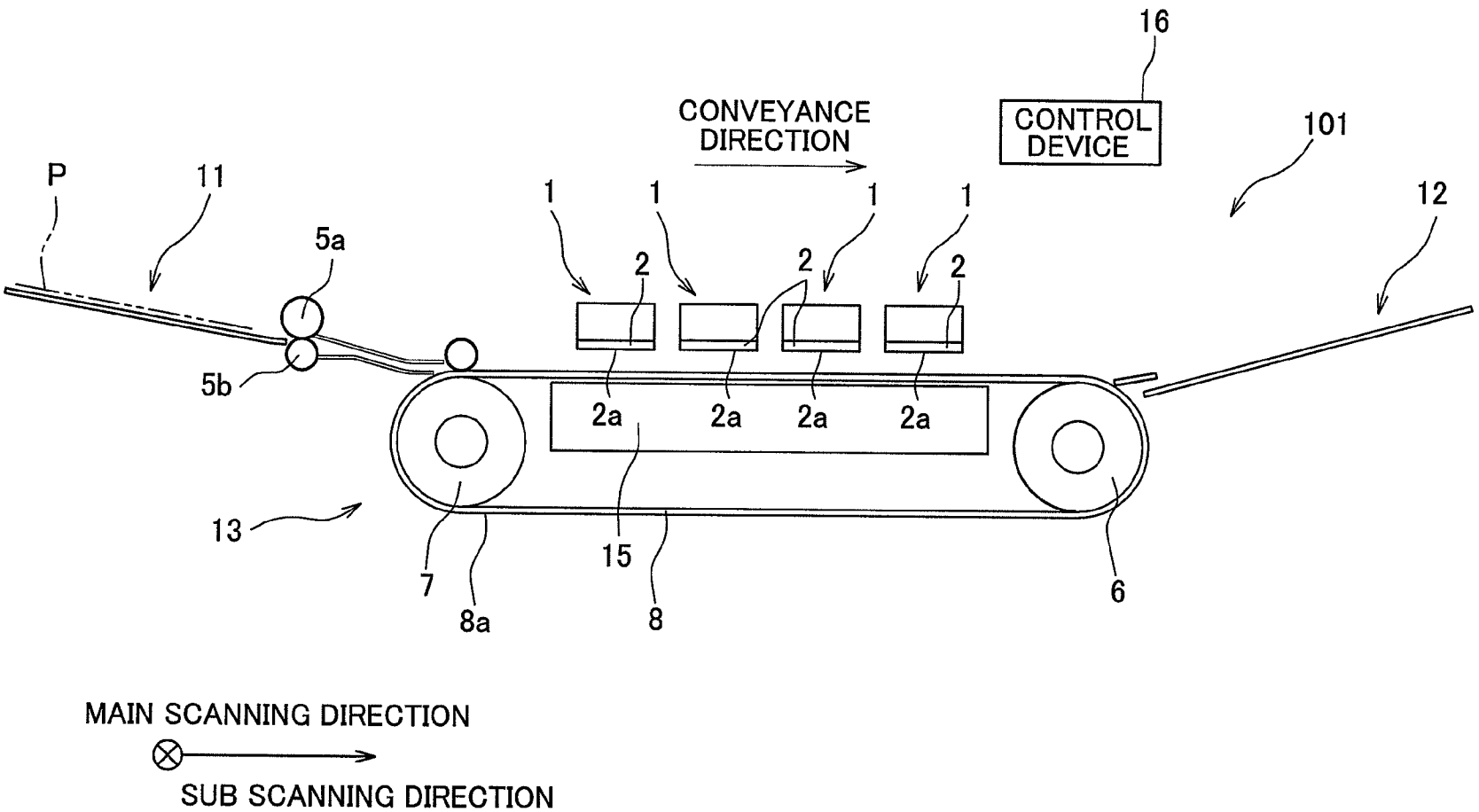
FIG. 1 is a side view of an inkjet printer according to a first embodiment of the present invention.

An inkjet printer 101 according to a first embodiment of the present invention is a color inkjet printer having four inkjet head 1 which respectively eject four different colors of ink (yellow, magenta, cyan, and black), as illustrated in FIG. 1. The inkjet printer 101 has a sheet feed tray 11 and a sheet exit tray 12 on the left and right in FIG. 1, respectively.

Inside the inkjet printer 101 is a conveyance path through which a sheet P serving as a recording medium is conveyed from the sheet feed tray 11 towards the sheet exit tray 12. Immediately downstream of the sheet feed tray 11 is a pair of sheet feed rollers 5*a* and 5*b* which sandwich a sheet therebetween and convey the sheet. The pair of sheet feed rollers 5*a* and 5*b* send a sheet P from the sheet feed tray 11 to the right in FIG. 1.

The sheet P sent out by the pair of sheet feed rollers 5*a* and 5*b* is fed to a conveyance mechanism 13. The conveyance mechanism 13 includes two belt rollers 6 and 7, a conveyor belt 8, and a platen 15. The conveyor belt 8 is an endless belt looped around the rollers 6 and 7. The platen 15 is disposed within a region surrounded by the conveyor belt 8, to a position where the platen 15 faces the four inkjet heads 1.

The conveyance mechanism 13 is provided to a middle portion of the conveyance path of a sheet. The conveyance mechanism 13 includes the two belt rollers 6 and 7, the conveyor belt 8, the platen 15, and a conveyor motor 19 (see FIG. 7). The conveyor motor 19 rotates the belt roller 6 clockwise to cause the conveyor belt 8 to rotate clockwise. Thus, the conveyor belt 8 keeps a sheet P pressed onto an adhesive outer circumferential surface thereof, and conveys the sheet P towards the sheet exit tray 12.

The four inkjet heads 1 are aligned in a conveyance direction of a sheet P; i.e., a sub scanning direction, and are fixed to positions where the four inkjet heads 1 face the conveyance path. In short, the inkjet printer 101 is a line printer. The four inkjet heads 1 each have a head main body 2 at a lower end thereof. The head main body 2 is a rectangular parallelepiped long in a direction perpendicular to a main scanning direction; i.e., the conveyance direction. A bottom surface of the head main body 2 serves as an ejection face 2*a* facing a conveyor face provided to an upper side of the outer circumferential surface of the conveyor belt 8. Ink droplets of the respective colors are ejected towards an upper surface of the sheet P; i.e., print surface, when the sheet P conveyed on the conveyor belt 8 sequentially passes immediately below the four head main bodies 2. A desired color image is thus formed on the sheet P. A series of processes described above: sheet feeding; image formation; sheet discharging, are synchronizingly carried out by a control device 16.

The following describes the head main bodies 2 with reference to FIGS. 2 to 5. In order to simplify the figure, actuator units 21 are drawn with double-dashed-chain lines in FIG. 3 although they are supposed to be drawn with solid lines. Moreover, ejection openings 108, pressure chambers 110, and apertures 112 are drawn with solid lines in FIG. 3 although they are supposed to be drawn with broken lines.

Installed to each of the head main body 2 are a not-illustrated reservoir unit which supplies ink, and the like. Each of the inkjet heads 1 is thus formed. The inkjet heads 1 are connected to a driver IC 51 (see FIG. 7) which is a part of the control device 16. The driver IC 51 selectively generates one of a first and a second ejection signals to be supplied to an actuator unit 21. The driver IC 51 has a temperature sensor 51*a* (see FIG. 7) built therein. The driver IC 51 is thermally bonded to the reservoir unit which supplies ink to a passage unit 9.

Figure 2:
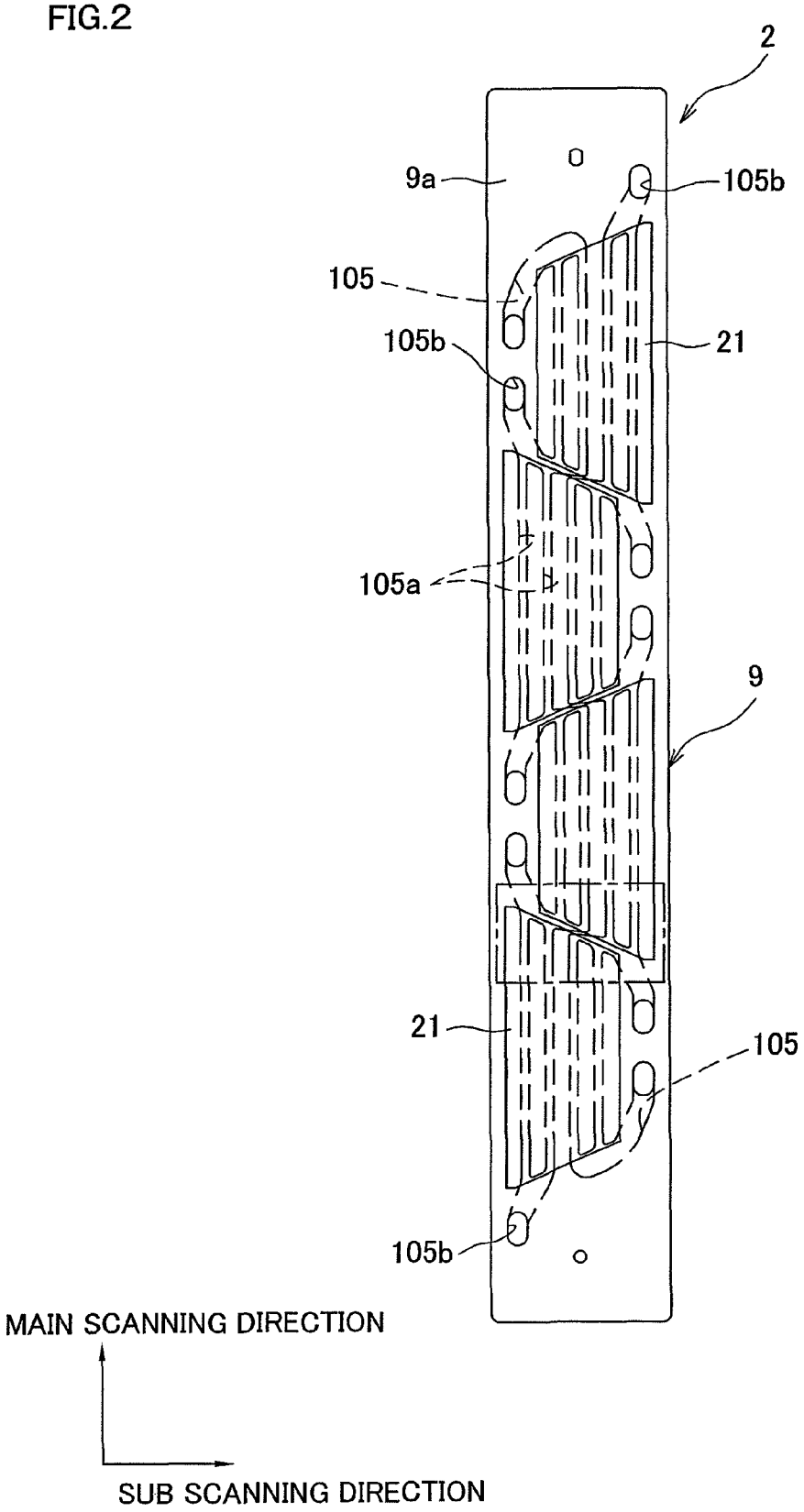
FIG. 2 is a plan view of a head main body illustrated in FIG. 1.
Figure 3:
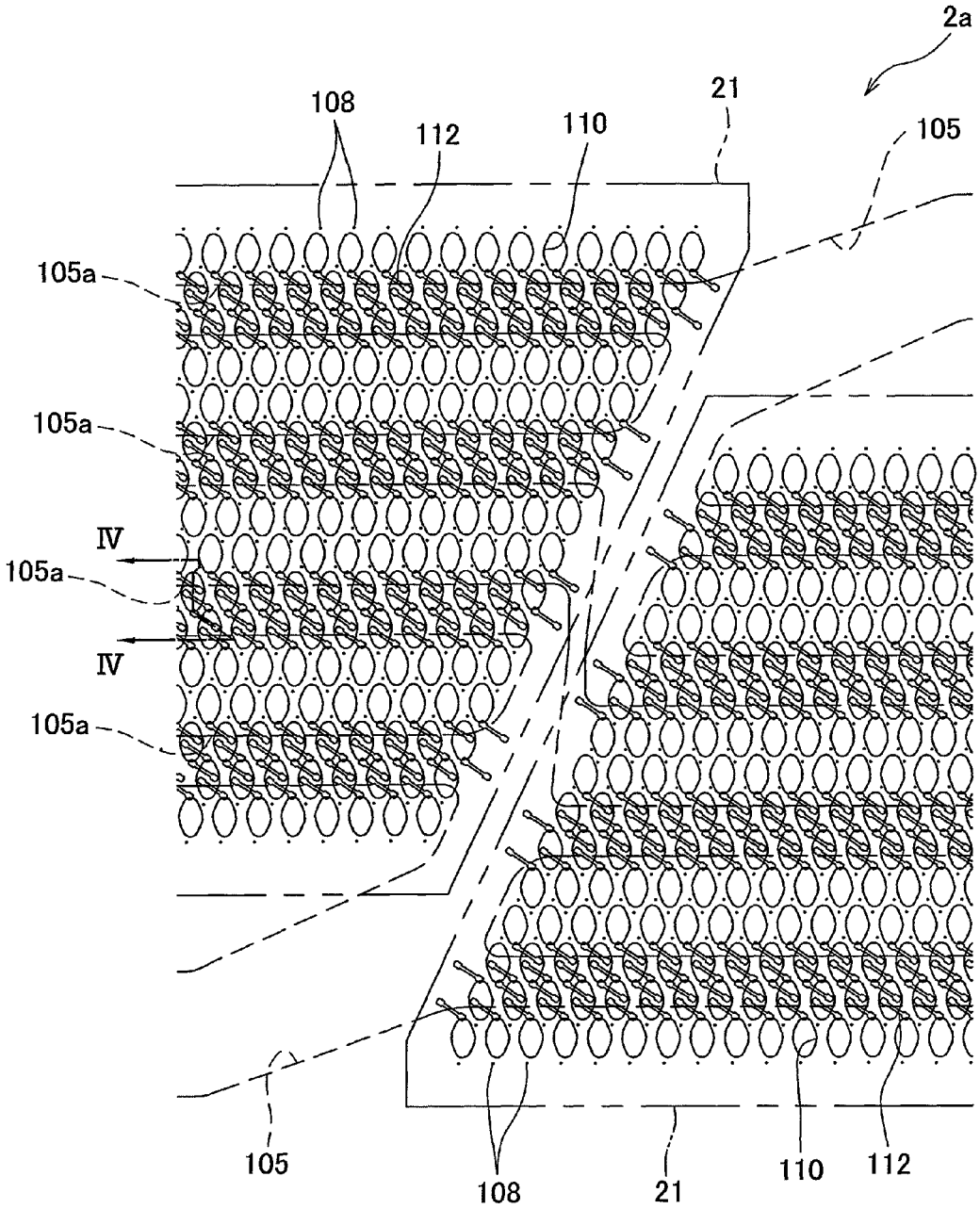
FIG. 3 is a magnified view of a region surrounded by a dotted line in FIG. 2.

The head main bodies 2 each include a passage unit 9 and four actuator units 21 fixed to an upper surface 9*a* of the passage unit 9, as illustrated in FIG. 2. The actuator units 21 each include a plurality of individual electrodes 135 respectively provided facing a plurality of pressure chambers 110 provided to the passage unit 9. The actuator units 21 each have a function of selectively applying ejection energy to ink inside the pressure chambers 110.

Figure 4:
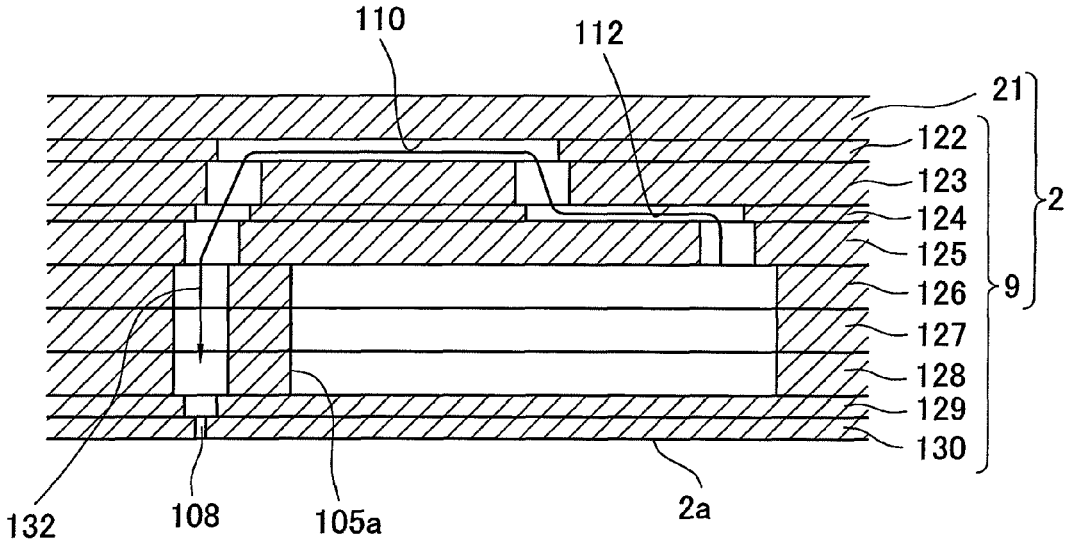
FIG. 4 is a cross-sectional view taken along the IV-IV line in FIG. 3.

The upper surface 9*a* of the passage unit 9 has a total of ten ink supply openings 105*b* open thereon. An interior of the passage unit 9 are: a plurality of manifold passages 105 each having an ink supply opening 105*b* at its one end; and a plurality of sub manifold passages 105*a* branching off from the manifold passages 105. The sub manifold passages 105*a* are each long in the main scanning direction. One manifold passage 105 branches off in two or four sub manifold passages 105*a*. The actuator units 21 each overlap with four sub manifold passages 105*a* in plan view. A lower surface of the passage unit 9 serves as an ejection face 2*a*. The ejection face 2*a* has ejection openings 108 each of which is a nozzle opening, arranged in a matrix; i.e., regularly and two-dimensionally, as illustrated in FIG. 4. An upper surface of the passage unit 9 are pressure chambers 110 arranged in a matrix. One ejection opening 108 corresponds to a plurality of dots arranged in the conveyance direction in an image formed on the sheet P.

In the present embodiment, the pressure chambers 110 form sixteen parallel pressure chamber columns extending in the main scanning direction on the upper surface of the passage unit 9. In accordance with an exterior shape of the actuator unit 21, a pressure chamber column closer to a long edge of the actuator unit 21 includes more pressure chambers 110 than a pressure chamber column closer to a short edge of the actuator unit 21 does. On the ejection face 2*a*, ejection openings 108 are arranged in the same manner as the pressure chambers 110.

The passage unit 9 is composed of plates 122 to 130 made of metal such as stainless steel, as illustrated in FIG. 4. The plates 122 to 130 each have a rectangular plane long in the main scanning direction. The plates 122 to 130 are aligned and layered on each other in order to connect through holes respectively formed on plates 122 to 130. This creates individual ink passages 132 each running from an exit of a sub manifold passage 105*a* through a pressure chamber 110 to an ejection opening 108.

The following describes a flow of ink in passage unit 9. Ink supplied inside the passage unit 9 from the reservoir unit through the ink supply openings 105*b* is branched off from the manifold passages 105 to the sub manifold passages 105*a*. The ink inside each of the sub manifold passages 105*a* flows into each of the individual ink passages 132, and reaches the corresponding ejection opening 108 through an aperture 112 functioning as a throttle, and the pressure chamber 110.

The following describes an actuator unit 21. Each of the four actuator units 21 has a trapezoidal planer shape, as illustrated in FIG. 2. The four actuator units 21 are arranged in staggered fashion so as to avoid the ink supply openings 105*b*. Parallel sides of each of the actuator units 21 extend in a longitudinal direction of the passage unit 9. An oblique side of an actuator unit 21 overlaps an oblique side of an adjacent actuator unit 21 in a width direction of the passage unit 9; i.e., sub scanning direction.

Figure 5:
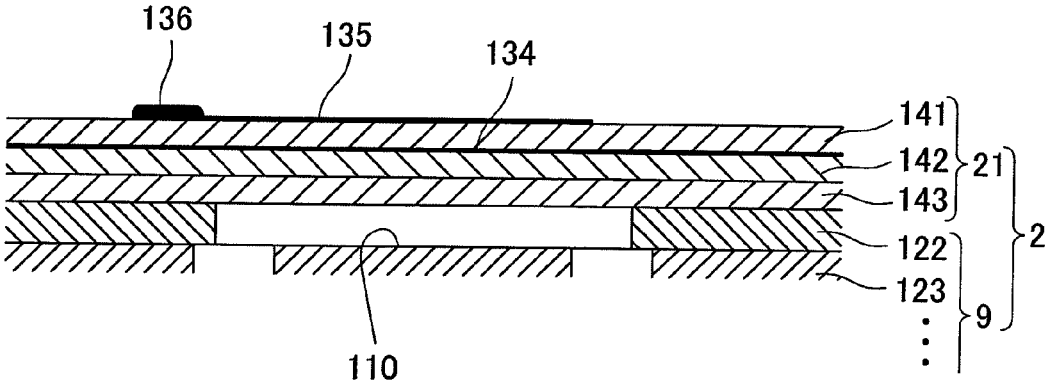
FIG. 5 is a partial cross-sectional view of an actuator unit included in the inkjet head.
Figure 6:
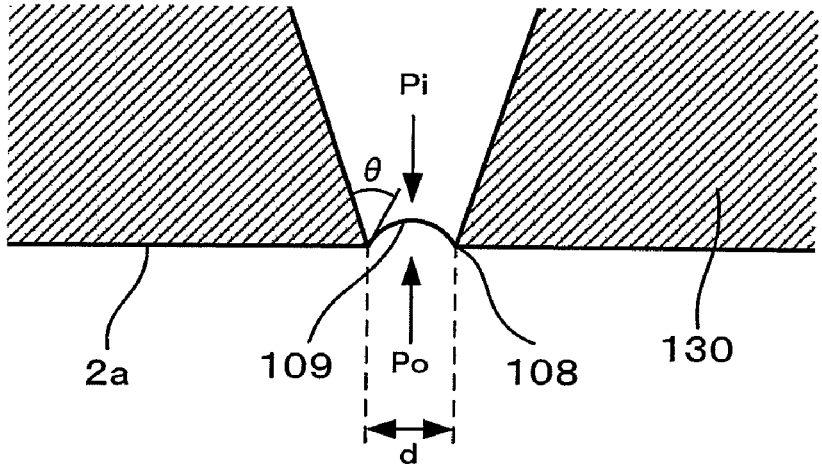
FIG. 6 is a schematic cross-sectional view of a nozzle plate, illustrating a meniscus formed in an ejection opening.

The actuator units 21 each include a plurality of actuators each facing a pressure chamber 110. The actuators each selectively apply ejection energy to ink in the pressure chamber 110 facing the actuator. Specifically, the actuator unit 21 is composed of three piezoelectric layers 141 to 143 each made of a ferroelectric lead zirconate titanate (PZT) ceramic material, as illustrated in FIG. 5. Individual electrodes 135 are provided to an upper surface of the uppermost piezoelectric layer 141, the individual electrodes 135 respectively facing the pressure chambers 110. The uppermost piezoelectric layer 141 and the piezoelectric layer 142 thereunder have a common electrode 134 interposed therebetween formed over the entire sheet. The individual electrodes 135 each have a substantially rhombic planer shape, similar to the pressure chambers 110. Most part of each of the individual electrodes 135 falls within a region of the corresponding one of the pressure chambers 110 in plan view. One of acute angled parts of each of the substantially rhombic individual electrodes 135 extends outside of the corresponding pressure chamber 110. The one acute angled part is provided with a circular land thicker than the individual electrodes 135.

Due to a signal given by the driver IC 51, the common electrode 134 is retained at a ground potential uniformly at regions corresponding to all the pressure chambers 110. Meanwhile, the individual electrodes 135 are respectively connected electrically to terminals of the driver IC 51 through the lands 136 and wires. This allows the driver IC 51 to supply a first or a second ejection signal only to desired one or more of the individual electrodes 135. Thus, parts of the actuator unit 21 function as individual actuators, each of the parts being sandwiched by an individual electrode 135 and the corresponding one of the pressure chambers 110. In other words, the actuator unit 21 is provided with the same number of actuators 4 as the pressure chambers 110.

The following describes a driving mode of the actuator unit 21. The piezoelectric layer 141 is polarized in its thickness direction. Meanwhile, the piezoelectric layers 142 and 143 are inactive layers which do not deform by themselves. The piezoelectric layers 141 to 143 are fixed on an upper surface of the cavity plate 122 which defines the pressure chambers 110. Thus, when the individual electrodes 135 and the common electrode 134 are at different potentials, and an electric field is impressed on the piezoelectric layer 141 in the polarized direction, a part of the piezoelectric layer 141 functions as an active portion which deforms due to a piezoelectric effect, to which part of the piezoelectric layer 141 the electric field is impressed. The active portion expands in a thickness direction and contracts along a surface when the electric field is in the same direction as the polarized direction. Accordingly, the part of the piezoelectric layer 141 where the electric field is impressed and the piezoelectric layers 142 and 143 thereunder exhibit different strains along the surface. As a result, the piezoelectric layer 141 to 143 as a whole present unimorph deformation in a convex shape towards each of the pressure chambers 110. This applies pressure; i.e., ejection energy to the ink inside the pressure chambers 110, thus generating a pressure wave in the pressure chambers 110. The pressure wave generated propagates from the pressure chambers 110 to corresponding ejection openings 108 to eject an ink droplet through each of the ejection openings 108.

In the present embodiment, the drive IC 51 outputs an ejection signal to each of the individual electrodes 135. The ejection signal applies a predetermined potential to the individual electrode 135 in advance, and temporarily applies a ground potential to the individual electrode 135, then reapplies the predetermined potential to the individual electrode 135 at predetermined timing. In such a case, the pressure of the ink inside the corresponding pressure chamber 110 decreases and thus the ink is sucked from the sub manifold passage 105*a* to the individual ink passage 132, at timing when the ground potential is applied to the individual electrode 135. Afterwards, when the predetermined potential is applied again to the individual electrode 135, the pressure of the ink inside the pressure chambers 110 increases, thus an ink droplet is ejected through each of the ejection openings 108. In short, a rectangular pulse is applied to the individual electrode 135. The pulse width is equal to an AL (Acoustic Length) which is a length of time it takes a pressure wave to propagate from an exit of the sub manifold passage 105*a* to a leading end of an ejection opening 108, in a pressure chamber 110. Hence, a positive pressure wave reflected thus reversed in phase returns and overlaps, in the pressure chamber 110, a positive pressure wave newly imposed by the actuator unit 21. Thus, a large pressure is imposed on the ink in the pressure chamber 110.

In the present embodiment, an amount of ink to be ejected through an ejection opening 108 in a printing cycle is any one of the following four types: zero; small amount (4 pl);

medium amount (8 pl); and large amount (12 pl). The amount of ink to be ejected is determined according to the number of pulses applied to the corresponding one of the individual electrodes 135 in one printing cycle. Specifically, the number of pulses to be applied to the individual electrode 135 in one printing cycle are one, two, and three when a small amount, a medium amount, and a large amount of ink are to be ejected, respectively. Note that a printing cycle is defined as a time necessary for a sheet to be conveyed in the sub scanning direction by a unit distance corresponding to print resolution; i.e., a minimum dot interval.

A meniscus, which is a border between the ink and the atmosphere, is formed in each ejection opening 108. The following studies a pressure difference of the atmosphere and the liquid sandwiching the meniscus (hereinafter simply referred to as "pressure difference Pd"). In the present embodiment, when the actuator is stopped or not in a driving mode, the atmospheric pressure Po of the meniscus is slightly lower than the ink pressure Pi. This imposes on a meniscus 109 a hydraulic head pressure; i.e., a negative pressure corresponding to a pressure generated due to a difference between a vertical position of an ejection opening 108 and a position of the ink level in the ink tank. This causes the meniscus 109 to curve in a convex shape towards inside the ejection opening 108. Further, driving of the actuator causes an ink droplet to be ejected. Thus, if ink is not replenished promptly, the meniscus 109 deforms in a convex shape further towards the ejection opening 108.

The below equation indicates a meniscus pressure resistance P.

$$P=4\sigma\cdot\cos\theta/d$$

σ: surface tension of ink

θ: contact angle of ink on an ejection opening 108 d: diameter of the ejection opening 108

Surface tension σ of ink increases as the viscosity of ink increases. The viscosity of ink decreases as an ink temperature T increases. Thus, the meniscus pressure resistance P decreases as the ink temperature T increases.

The below equation indicates the ink pressure Pi of the meniscus.

$$Pi=P0+\Delta P \quad P0\text{: hydraulic head pressure}$$

ΔP: pressure loss

The below equation indicates a pressure loss ΔP.

$$\Delta P=Q\cdot R$$

Q: amount of ink to be ejected through the ejection opening 108.

R: passage resistance in ink passage from ink tank to the ejection opening 108.

Further, the passage resistance R is determined based on a cross-sectional shape of the ink passage and the ink viscosity μ. Further, the ink viscosity μ varies according to the ink temperature T. Accordingly, a pressure difference Pd (=Pi−Po) in a steady state varies in accordance with the ink amount Q to be ejected through the ejection openings 108 and the ink temperature T.

Figure 7:
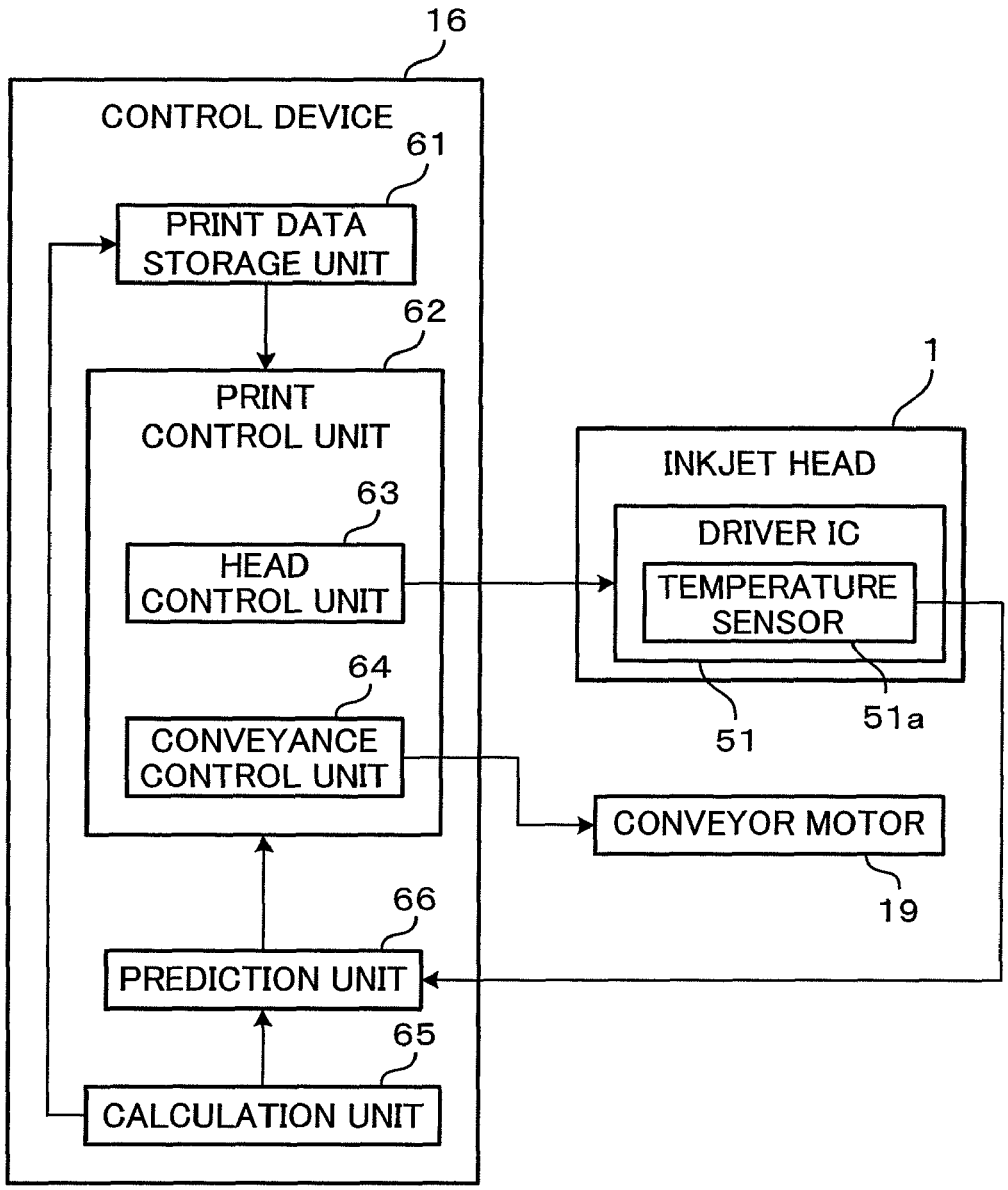
FIG. 7 is a functional block diagram of the control device illustrated in FIG. 1.

The following describes the control device 16 in detail, with reference to FIG. 7. In order to simplify the figure, it is depicted as if only one of the four inkjet heads 1 is connected to the control device 16 in FIG. 7.

The control device 16 includes a print data storage unit 61, a print control unit 62, a calculation unit 65, and a prediction unit 66, as illustrated in FIG. 7.

The print data storage unit 61 stores therein print data transferred from a not illustrated host computer. The print data includes image data related to an image to be printed on a sheet P. The image data has a drive data format used for a later-described head control unit 63 to drive the actuator unit 21. The drive data indicates which one of the following four types of ink amount is to be ejected in each printing cycle through each of the ejection openings 108: zero, small amount, medium amount, and large mount.

Figure 8A:
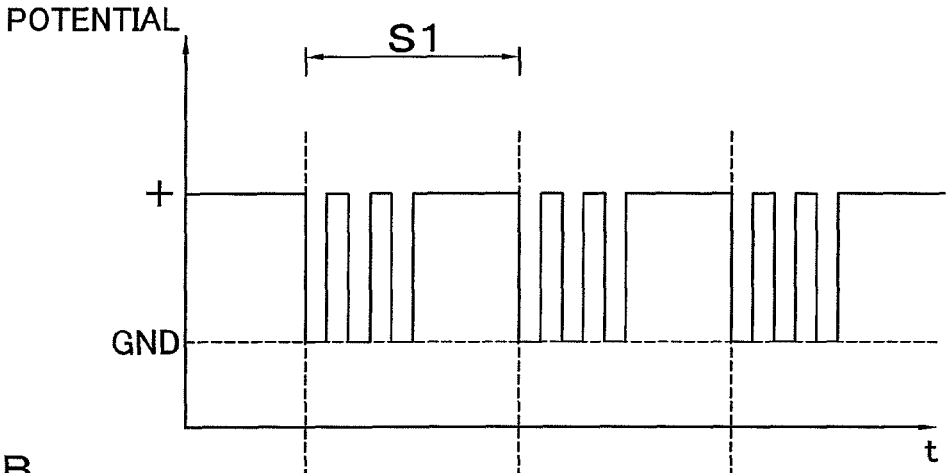
FIG. 8A is a graph showing a waveform of a first ejection signal.
Figure 8B:
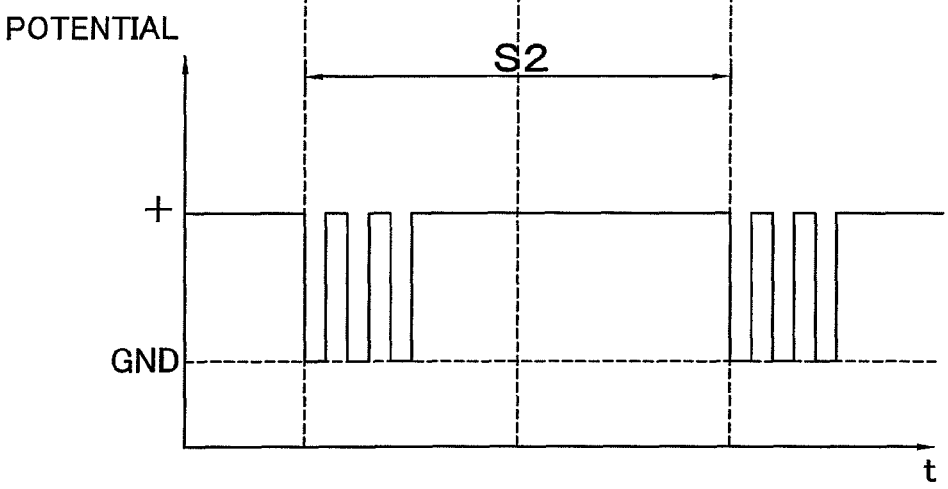
FIG. 8B is a graph showing a waveform of a second ejection signal.

The print control unit 62 includes the head control unit 63 and a conveyance control unit 64. The head control unit 63 outputs to the driver IC 51 drive data and a control signal. The control signal instructs which ejection signals are to be generated, i.e., first ejection signals and second ejection signals. When the control signal instructs to generate first ejection signals, the driver IC 51 generates first ejection signals based on the drive data, each first ejection signal having a cycle S1 (first frequency f1). When the control signal instructs to generate second ejection signals, the driver IC 51 generates second ejection signals based on the drive data, each second ejection signal having a cycle S2 (second frequency f2). A signal outputted by the prediction unit 66 changes an instruction from a control signal outputted by the head control unit 63, the instruction indicating which ejection signals are to be generated. Each first ejection signal is a signal whose cycle S1 is 50 μsec (20 kHz). Each first ejection signal has zero, one, two, or three pulse(s) in one cycle. FIG. 8A illustrates as an example the first ejection signal which includes three pulses in one cycle. Each second ejection signal has a variable frequency f2, as described later. Each second ejection signal may be a signal whose cycle S2 is 100 μsec (10 kHz). Each second ejection signal includes zero, one, two, or three pulse(s). FIG. 8B illustrates as an example the second ejection signal which includes three pulses in one cycle. The cycles S1 and S2 are equal to a printing cycle of the printer 101.

The conveyance control unit 64 outputs a control signal to the conveyance motor 19. The control signal instructs that a sheet P is conveyed at a speed corresponding to a cycle (S1 or S2) of ejection signals generated by the driver IC 51. Specifically, the conveyance control unit 64 controls the conveyor motor 19 so that a sheet P is conveyed at a first conveyance speed when first ejection signals are generated by the driver IC 51. Meanwhile, the conveyance control unit 64 controls the conveyor motor 19 so that a sheet P is conveyed at a second conveyance speed which is f2/f1 of the first conveyance speed when second ejection signals are generated by the driver IC 51.

Assuming that first ejection signals are supplied to the ejection head 1, the calculation unit 65 sequentially calculates, for respective constant periods of time, variations in total amount of ink to be ejected through the ejection openings 108 provided to the inkjet head 1. The calculation is carried out with respect to all the ejection openings 108 provided to the inkjet head 1. In the present embodiment, the calculation unit 65 sequentially calculates variations as differences between total amount of ink to be ejected through all the ejection openings 108 in consecutive two periods which is a natural number multiple of a printing cycle; i.e., a total amount of ink at one period minus a total amount of ink at the preceding period. In the present embodiment, one period is equal to time obtained by dividing a 1/n of the length of a sheet P in the conveyance direction by conveyance speed. In other words, the calculation unit 65 calculates n variations ΔV for one sheet. One period is two to nine times as long as a printing cycle S, for example.

The prediction unit 66 predicts whether the pressure difference Pd (Pd=Pi−Po) falls below a threshold value k which is a negative value; i.e., exhibit an overbalance state. Here, the threshold value k is such a value whose absolute value is less than the withstanding pressure of the meniscus. According to a perception of the present inventor, a larger rate of variation in total amount of ink to be ejected through the ejection openings 108 leads to a higher possibility that a minimum value of the pressure difference Pd falls below the threshold value k. More specifically, the present inventor discovered that there is a higher possibility that the pressure difference Pd falls below the threshold value k when a predetermined number or more of one or more variations in total amount of ink calculated for respective periods exceed a predetermined value. The predetermined number, the predetermined value, and the period are correlated: a longer period leads to a fewer predetermined number and a larger predetermined value, when the total amount of ink monotonically increases. In the present embodiment, a period is denoted by U, where the predetermined number is one and the predetermined value is X1. Thus, the prediction unit 66 predicts that the pressure difference Pd falls below the threshold value k when at least one of the n variations ΔV exceeds the predetermined value X1, the variations ΔV each being calculated by the calculation unit 65 for period U.

When the prediction unit 66 predicts that the pressure difference Pd does not fall below the threshold value k, the head controller 63 outputs a control signal which instructs the driver IC 51 to generate first ejection signals. When the prediction unit 66 predicts that the pressure difference Pd falls below the threshold value k, the head controller 63 outputs a control signal which instructs the driver IC 51 to generate second ejection signals.

The meniscus pressure resistance P decreases as the ink temperature T increases. The prediction unit 66 has a table which associates the ink temperature T with the predetermined value X1. With reference to the table, the prediction unit 66 decreases the predetermined value X1 as the ink temperature T increases. The prediction unit 66 calculates, on the basis of an output signal from the temperature sensor 51*a* in the driver IC 51, the temperature T of ink inside the passage unit 9. As a modification, the predetermined value X1 may be constant, regardless of the ink temperature T.

As an example, the following studies a case where all the ejection openings 108 except for one each eject a large mount of ink (12 pl) among the four types of ink amount consecutively for all the printing cycles during printing on one sheet P.

Figure 9:
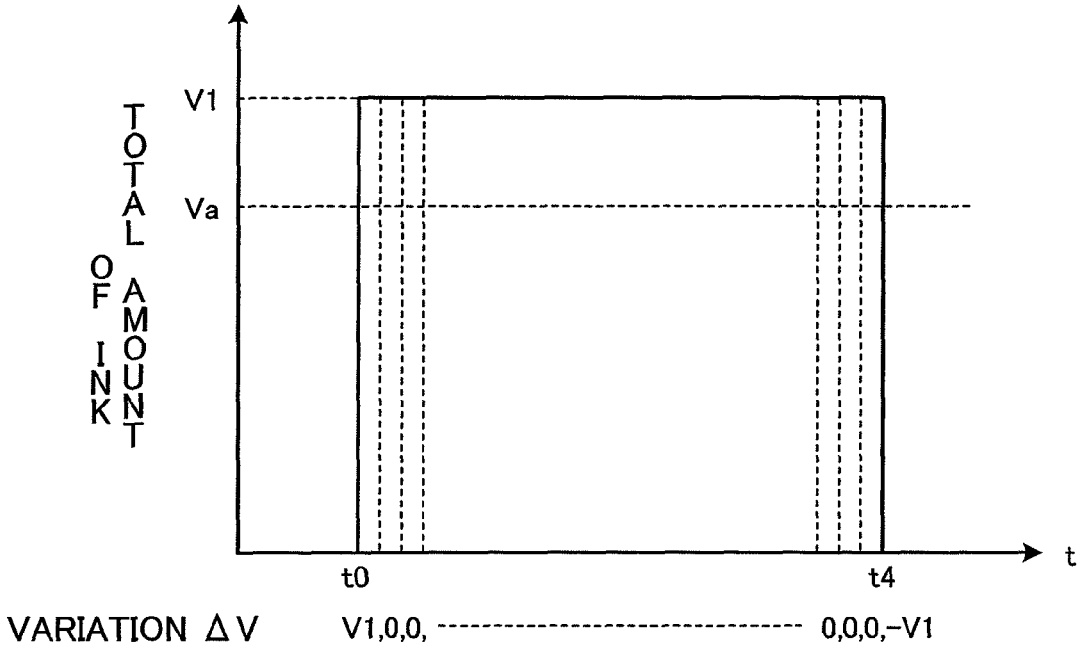
FIG. 9 is a graph showing an example of time-dependent change in total amount of ink to be ejected through all the ejection openings when first ejection signals are supplied to the inkjet head.

In this case, as illustrated in FIG. 9, total amounts of ink to be ejected in the entire periods U are each constantly V1, the period U beginning with an ejection start time t0 indicating the time when ejection on a sheet P starts. Accordingly, the variation ΔV in the first period U1 is V1. The variations ΔV from the next period U2 to the last period Un are each zero. The variation ΔV is −V1 in the period next to the last period Un.

Figure 10:
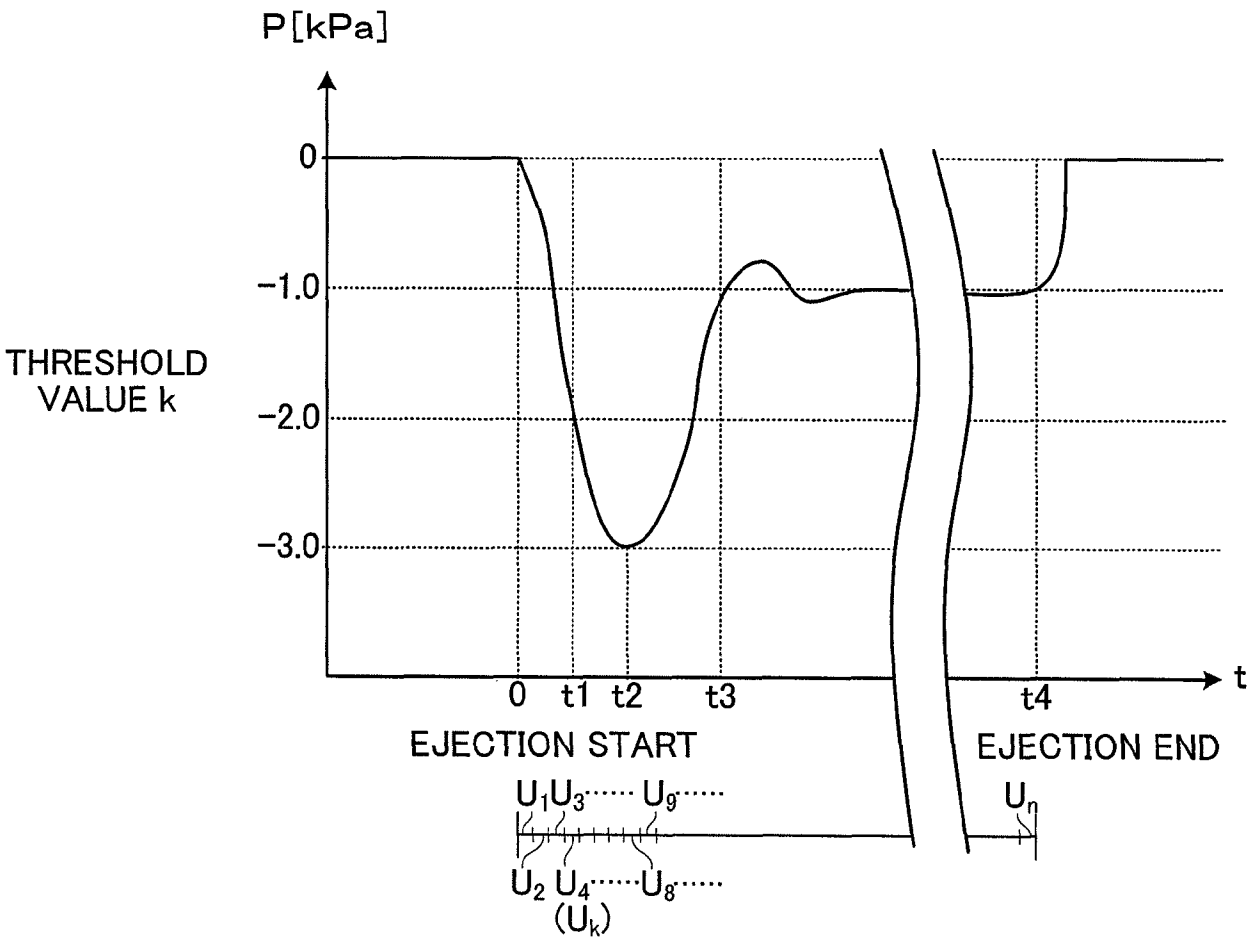
FIG. 10 is a graph showing an example of change in ink pressure in a sub manifold passage and an individual ink passage.

FIG. 10 is a graph illustrating changes in the pressure difference Pd in such a case where the total amount of ink changes as illustrated in FIG. 9. In FIG. 10, n periods U are sequentially denoted by U1, U2 . . . and Un. Due to slightly short supply of ink to the sub manifold passages 105*a* or individual ink passages 132, the pressure difference Pd rapidly decreases as soon as ejection of ink begins, and the pressure difference Pd falls below −2.0 kPa at time t1, as illustrated in FIG. 10. The pressure difference Pd then reaches the minimum value −3.0 kPa at time t2, and rapidly increases from time t2 to time t3 thereafter. In other words, between time t0 and time t3 is an unsteady state where flow of ink is unstable. At time t3 and thereafter, amount of ink to be ejected through the ejection openings 108 and amount of ink to be supplied to the individual passage 132 balance each other out to establish a steady state, where the pressure difference Pd is maintained substantially at −1.0 kPa, and returns to zero at time t4 when printing ends.

If the pressure resistance P of a meniscus formed in an ejection opening 108 is −3.0 kPa, the meniscus possibly breaks at around time t2 if no ink is to be ejected through the ejection opening 108. Thus, taking into account a possible redundancy, the predetermined value X1 is determined on the premise that the threshold value k is −2.0 kPa in the present embodiment.

Specifically, the predetermined value X1 is preferably determined on the premise that the threshold value k is such a value as described below. After a certain period of time has elapsed after ejection of ink droplets through the ejection openings 108 has started, amount of ink to be ejected through the ejection openings 108 and amount of ink supplied to the sub manifold passages 105*a* and the individual ink passages 132 balance each other out to establish a steady state, as illustrated in FIG. 10 between time t3 and time t4. The predetermined value X1 is determined on the premise that the threshold value k falls below the pressure difference Pd in the steady state (−1.0 kPa) but larger than the meniscus pressure resistance P (−3.0 kPa). This prevents the meniscus from breaking, while not requiring unnecessary change from the first ejection signal to the second ejection signal, thus avoiding a long printing period to one sheet P.

Applied to examples illustrated in FIGS. 9 and 10, the calculation unit 65 performs calculations to obtain V1 as a variation ΔV at period U1, to obtain 0 as variations ΔV from period thereafter until period Un. The prediction unit 66 determines whether each of the n variations ΔV calculated by the calculation unit 65 exceeds the predetermined value X1. In the present embodiment, only the variation V1 calculated at period U1 exceeds the predetermined value X1 (V1>X1). The predetermined number in the present embodiment is one, as described above. The prediction unit 66 thus predicts that the pressure difference Pd falls below the threshold value k.

When the prediction unit 66 predicts that the pressure difference Pd does not fall below the threshold value k, the head control unit 63 supplies a control signal to the driver IC 51 to instruct generation of first ejection signals. When the prediction unit 66 predicts that the pressure difference Pd falls below the threshold value k, the head control unit 63 supplies a control signal to the driver IC 51 to instruct generation of second ejection signals. Further, when the prediction unit 66 predicts that the pressure difference Pd falls below the threshold value k, the head control unit 63 refers to a result of calculation performed by the calculation unit 65. Assuming that second ejection signals are supplied to the inkjet head 1, the head control unit 63 determines the second frequency f2 so that none of the variations in the total amount of ink to be ejected through the ejection openings 108 for respective periods U exceeds the predetermined value X1. The head control unit 63 determines the second frequency which decreases as the variation ΔV calculated by the calculation unit 65 increases. The relation between the variation ΔV and the second frequency is stored in the head control unit 63 in advance. The head control unit 63 supplies a signal indicating the second frequency and a control signal to the driver IC 51.

Figure 11:
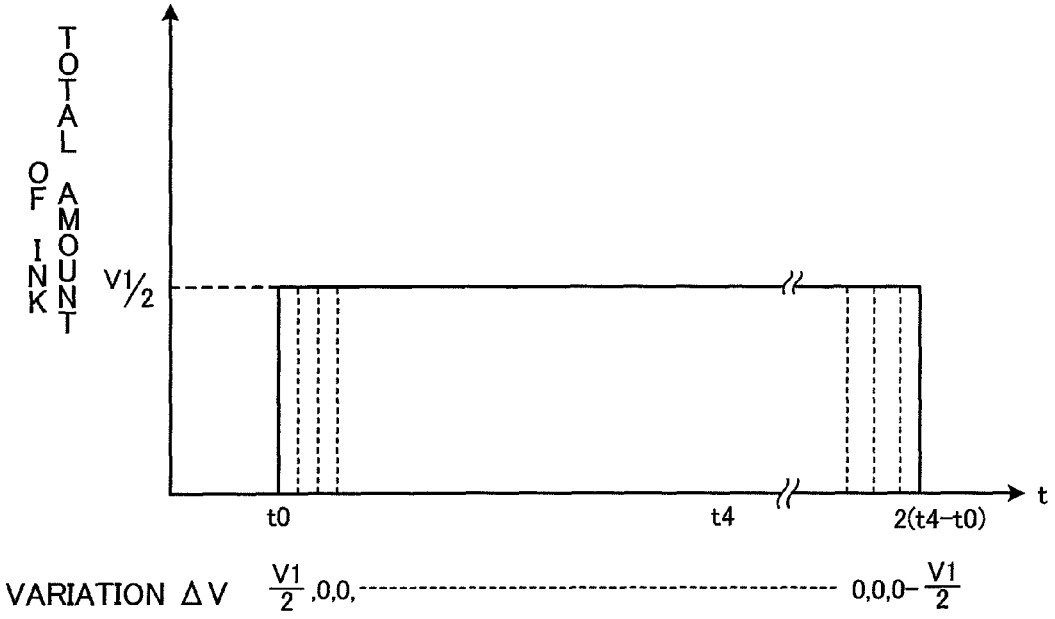
FIG. 11 is a graph showing an example of time-dependent change in total amount of ink to be ejected through the ejection openings when second ejection signals are supplied to the inkjet head.

When the second frequency determined as above is half of the first frequency, a total amount of ink to be ejected within the period U1 is V1/2, the period U1 beginning with the ejection start time t0, as illustrated in FIG. 11. Thus, the variation ΔV in period U1 is V1/2. The variations ΔV from the next period U2 until the last period Un are zero. The variation ΔV is −V1/2 in the period next to the last period Un. In this case, V1/2 is smaller than the predetermined value X1. Thus, none of the variations ΔV calculated in the periods U exceeds the predetermined value X1. At this time, the conveyance control unit 64 controls the conveyor motor 19 so that a sheet P is conveyed at the second conveyance speed half of the first conveyance speed. In this case, printing on the sheet P requires twice as much time as when the first ejection signals illustrated in FIG. 9 are supplied to the inkjet head 1.

According to the present embodiment, when the prediction unit 66 predicts that the pressure difference Pd sandwiching the meniscus falls below the threshold value k, second ejection signals each having a lower frequency than a first ejection signal is supplied to the inkjet head 1, as described above. Thus, the variations in total amount of ink to be ejected through the ejection openings 108 decrease below the threshold value X1 in any period U. Thus, the pressure difference Pd does not fall below the threshold value k even though cross-sectional areas of the passages are not enlarged. This realizes a small recording head 1 while preventing the meniscus from breaking.

Further, the prediction unit 66 predicts that the pressure difference Pd falls below the threshold value k when even one of the variations ΔV exceeds the threshold value X1, the variations ΔV being calculated for respective n periods U during printing on one sheet P. Following this prediction, the head control unit 63 causes a second ejection signal to be supplied to the inkjet head 1. Hence, the pressure difference Pd does not fall below the threshold value k at any period U, thus surely preventing the meniscus from breaking.

In addition, the prediction unit 66 decreases the predetermined value X1 as the ink temperature T increases. This prevents the meniscus from breaking even when the ink viscosity μ decreases as the ink temperature T increases.

<Modification 1>

Although the second frequency is variable in the first embodiment, the second frequency may be a constant value lower than the first frequency. This prevents a meniscus from breaking due to a higher possibility of the pressure difference Pd falling below the threshold value k, even when the second frequency causes at least one of the variations in total amount of ink to exceed the first predetermined value X1.

<Modification 2>

Further, in the first embodiment, the prediction unit 66 predicts that the pressure difference Pd falls below the threshold value k when at least one of the n variations ΔV exceeds the predetermined value X1. The prediction unit 66, however, may predict that the pressure difference Pd falls below the threshold value k when more than one of the n variations ΔV exceed the predetermined value X1 (first predetermined value). This is because the standard reference number (first predetermined number) changes in accordance with the length of the period, as described above.

<Modification 3>

In the first embodiment, the prediction unit 66 makes predictions only with the n variations ΔV. As it is also understood from FIG. 10, however, the prediction of whether the pressure difference Pd falls below the threshold value k is more accurately made, in addition to the variations ΔV, with consideration of a period of time in which at least a certain amount of ink is continuously ejected (duration). From this perspective, in the present modification, the prediction unit 66 predicts that the pressure difference Pd falls below the threshold value k when the first predetermined number or more variations ΔV out of the n variations calculated by the calculation unit 65 exceed the first predetermined value and total amount of ink to be ejected through the ejection openings 108 exceed a second predetermined value for consecutive second predetermined number of periods. The periods about the consecutive second predetermined number begins at a period A which is defined such that the variation ΔV in the period A is equal to or less than the first predetermined value and the variation ΔV in a period B immediately before the period A exceeds the first predetermined value.

Figure 12:
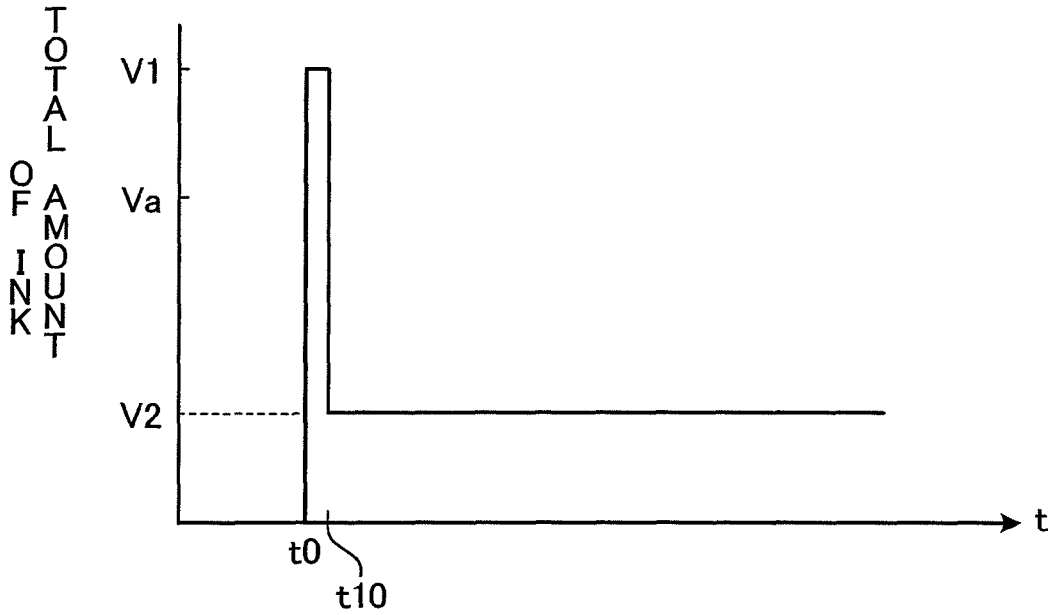
FIG. 12 is a graph related to modification 3 of the first embodiment of the present invention, showing an example of time-dependent change in total amount of ink to be ejected through the ejection openings.

The following describes the present modification in cases where the first predetermined number, the first predetermined value, the second predetermined number, and the second predetermined value are respectively one, X1, two, and Va, with reference to FIGS. 9 and 12. When ink is to be ejected in such a pattern as illustrated in FIG. 9, the variation ΔV (=V1) at period U1 exceeds the first predetermined value X1. At period U2 and thereafter for a long time, the total amount of ink is constant at V1 larger than a second predetermined value Va, and the variations ΔV is zero, which is equal or less than the first predetermined value X1. Thus, the total amount of ink each exceed the second predetermined value Va for at least two consecutive periods starting with period U2. This causes the prediction unit 66 to predict that the pressure difference Pd falls below the threshold value k.

In the ejection pattern illustrated in FIG. 12, the total amount of ink is V1 and the variation ΔV exceeds the first predetermined value X1 at period U1. At period U2 and thereafter for a long time, the total amount of ink is constant at V2 smaller than the second predetermined value Va. The variation ΔV at period U2 is V1−V2 equal to or smaller than the first predetermined value X1, and the ΔV is zero at period U3 and thereafter. Here, the total amount of ink does not exceed the second predetermined value Va at any of two or more consecutive periods starting from period U2. Thus, when ink is to be ejected in this pattern, the prediction unit 66 predicts that the pressure difference Pd does not fall below the threshold value k.

The first predetermined number, the first predetermined value, the second predetermined number, and the second predetermined number are appropriately determined in advance from a perspective of whether the pressure difference Pd falls below the threshold value k, based on an experiment performed on a plurality of combinations of these.

<Modification 4>

As another modification, assuming that first ejection signals are supplied to the inkjet head 1, the calculation unit 65 may sequentially calculate for respective periods U, with respect to each sub manifold passage 105*a*, variations ΔV of total amount of ink to be ejected through the ejection openings 108 connected to the sub manifold passage 105*a*. In this case, the prediction unit 66 predicts that the pressure difference Pd falls below the threshold value k when at least one of one or more variations ΔV calculated by the calculation unit 65 with respect to each sub manifold passage 105*a* exceeds the first predetermined value. In the modification, an average value of the variations ΔV calculated with respect to each sub manifold passage 105*a* is predicted to be 1/the number of sub manifold passages 105*a*. On the premise that all the sub manifold passages 105*a* each have the same capacity, the first predetermined value in the present modification is preferably (1/the number of sub manifold passages 105*a*) of that of the first embodiment. In actuality, however, the capacity of each sub manifold passage 105*a* is proportional to the number of individual ink passages 132 connected to the sub manifold passage 105*a*. Thus, a sub manifold passage 105*a* closer to a long edge of the actuator unit 21 has a higher capacity than a sub manifold passage 105*a* farther from the long edge. Therefore, the first predetermined value with respect to each sub manifold passage 105*a* is preferably (capacity of one sub manifold passage 105*a*/total capacity of the manifold passages 105*a* of the inkjet head 1) of that of the first embodiment. In other words, four types of sub manifold passages 105*a* each having a different capacity included in the inkjet head 1 leads to four different types of first predetermined values.

According to the present modification, second ejection signals are supplied to the inkjet head 1 when the pressure difference Pd with respect to any one of the sub manifold passages 105*a* falls below the threshold value k. This accordingly realizes a smaller inkjet head 1 while preventing the meniscus from breaking, as in the first embodiment. Further, this enables a more accurate prediction of whether the pressure difference Pd falls below the threshold value k.

<Modification 5>

Yet as another modification, the pressure differences Pd may be sequentially calculated using variations ΔV for respective constant periods of time and a prediction may be made by comparing the calculated pressure difference Pd and the threshold value k, unlike the first embodiment and modifications 1 to 4 each of which makes a prediction of whether the pressure difference Pd falls below the threshold value k on the basis of a comparison between the variation ΔV and the predetermined value X1. For instance, the prediction unit 66 predicts that the pressure difference Pd falls below the threshold value k when a predetermined number; e.g., one of the one or more pressure differences Pd calculated fall below the threshold value k. The duration mentioned in Modification 3 may be included when calculating the pressure difference Pd from the variation ΔV.

The following describes a procedure for calculating a pressure difference Pd from variations ΔV. In the present modification, a relation among the variation ΔV, the duration, and the pressure difference Pd is calculated from observation in advance. Specifically, a change in the pressure difference Pd with increase in the duration with respect to a variation ΔV is observed. This observation is carried out for many times with different variations ΔV. This way, a correspondence relationship among the pressure difference Pd and various combinations of a variation ΔV and a duration is known. The correspondence relationship is derived as a lookup table or a relation, and stored in the prediction unit 66. The relation may be derived not by an observation of the pressure difference Pd, but by a simulation based on a passage constant such as dimensions and a material quality of the passage, and physical properties of the ink such as the viscosity and composition of the ink.

The duration is calculated by the prediction unit 66 based on the image data. The prediction unit 66 calculates the pressure difference Pd using the lookup table or the relation, from the calculated variations ΔV and the number of periods (duration). The periods about the duration begins at a period C which is defined such that the variation ΔV in the period C is equal to or less than a third predetermined value and the variation ΔV in a period D immediately before the period C exceeds the third predetermined value. Further, in the periods, a fourth predetermined value or more total amount of ink is to be consecutively ejected through the ejection openings 108.

In the present modification, the pressure difference Pd is calculated using the variations ΔV, and a prediction is made based on a comparison between the calculated pressure difference Pd and the threshold value k. This enables an accurate prediction.

In the present modification, the threshold value k which is a negative value may increase as the ink temperature T detected by the temperature sensor 51*a* increases. Further, the present modification may be applied to Modifications 1 and 4.

Second Embodiment

Figure 13:
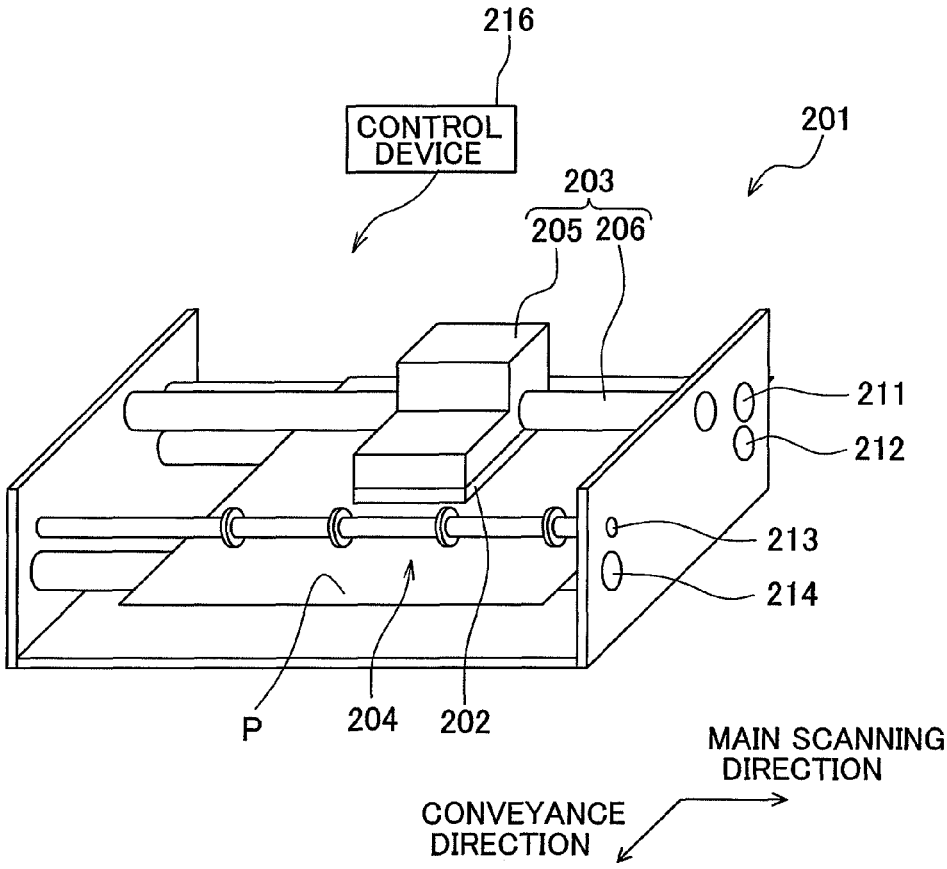
FIG. 13 is a perspective view of an inkjet printer according to a second embodiment of the present invention.
Figure 14:
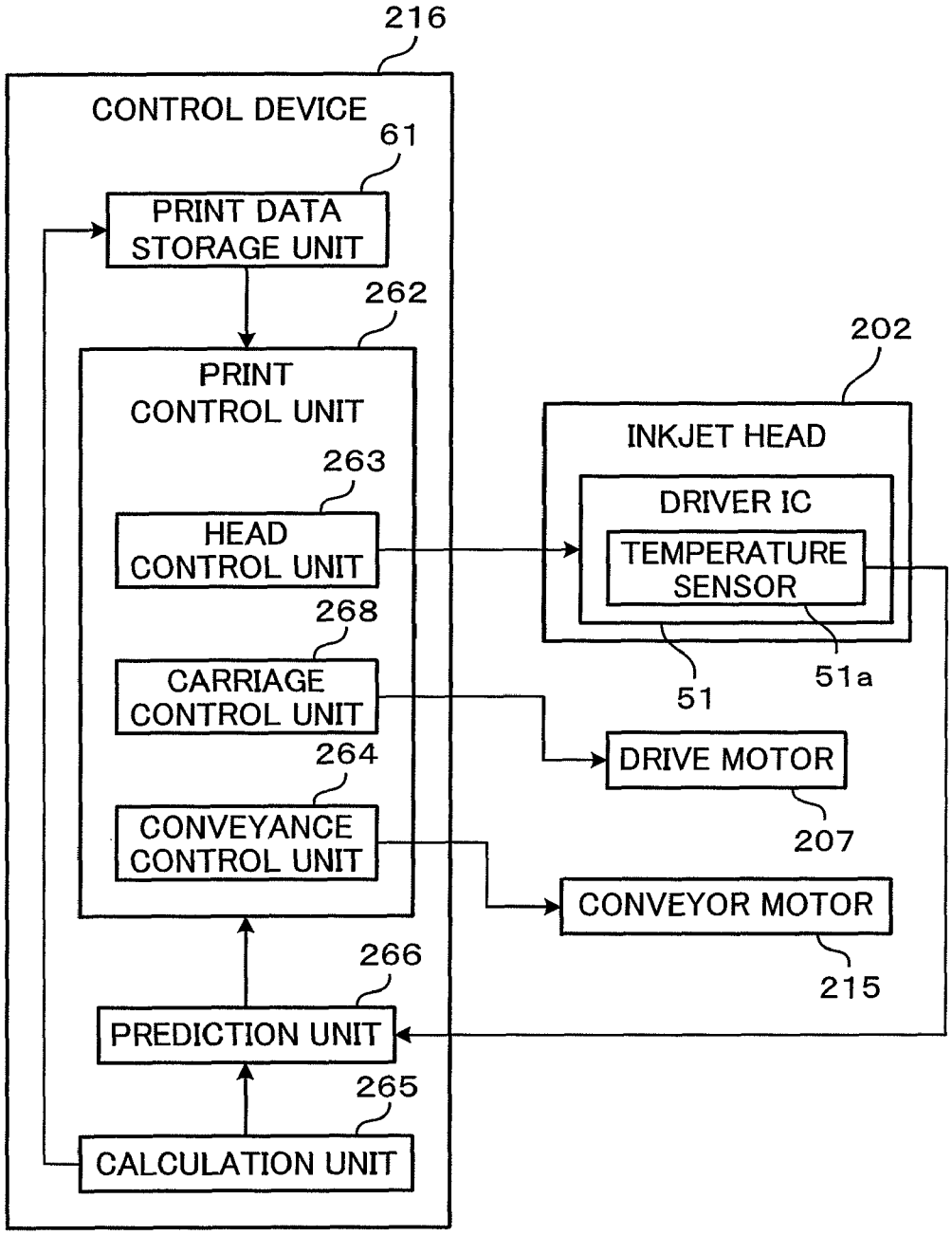
FIG. 14 is a functional block diagram of a control device illustrated in FIG. 13.

The following describes an inkjet printer 201 according to a second embodiment of the present invention, with reference to FIGS. 13 to 15. The inkjet printer 201 is a serial printer as illustrated in FIG. 13. The inkjet printer 201 includes: an inkjet head 202; a head moving mechanism 203; a conveyance mechanism 204; and a control device 216, as illustrated in FIG. 13. The control device 216 controls operations of the inkjet head 202, the head moving mechanism 203, and the conveyance mechanism 204.

The head moving mechanism 203 includes: a carriage 205; a guide 206; and a drive motor 207. Fixed to a lower surface of the carriage 205 is an inkjet head 202. The guide 206 extends in a main scanning direction (left-right direction in figure), and supports the carriage 205 so as to traverse a sheet P in the main scanning direction, allowing the carriage 205 to move forward and backward. The drive motor 207 moves the carriage 205 via a not-illustrated power transmission mechanism, under control of the control device 216.

An ejection face, which is a lower surface of the inkjet head 202, is provided with a plurality of ejection openings (not illustrated). Inside the head 202 are a common ink passage and individual ink passages (both not illustrated). To the common ink passage, ink is supplied from an ink tank. The individual ink passages each run from an exit of the common ink passage to an ejection opening. The inkjet head 202 is connected to a driver IC 51 which is part of the control device 216. The driver IC 51 generates ejection signals supplied to a plurality of actuators in the inkjet head 202. The actuators are individually driven in response to one of the ejection signals to apply pressure to ink inside a pressure chamber formed to a non-edge portion of an individual ink passage. This causes ink to be ejected through the ejection openings. Built into the driver IC 51 is a temperature sensor 51*a*. The driver IC 51 is thermally bonded to the inkjet head 202.

The conveyance mechanism 204 includes a conveyor motor 215, and two pairs of conveyor rollers 211 and 212; 213 and 214. The conveyor motor 215 drives the two pairs of rollers 211 and 212; 213 and 214. Each pair of the two pairs of rollers 211 and 212; 213 and 214 sandwich and convey a sheet P in a conveyance direction (direction from the back towards the front of the surface of the figure). The pair of conveyor rollers 211 and 212 are provided more upstream than the inkjet head 202 with respect to the conveyance direction. The pair of conveyor rollers 213 and 214 are provided more downstream than the inkjet head 202 with respect to the conveyance direction. The conveyor motor 215 drives the conveyor rollers 212 and 214 via a not-illustrated power transmission mechanism, based on control by the control device 216. The conveyor rollers 211 and 213 are driven rollers of the conveyor rollers 212 and 214, respectively. The conveyor rollers 211 and 213 thus rotate as a sheet is conveyed.

The control device 216 includes: a print data storage unit 61; a print control unit 262; a calculation unit 265; and a prediction unit 266, as illustrated in FIG. 14. The print data storage unit 61 has the same function as that of the first embodiment.

The control unit 262 includes: a head control unit 263; a carriage control unit 268; and a conveyance control unit 264. The carriage control unit 268 controls forward and backward movements of the carriage 205 via the drive motor 207 in such a manner that a stopping time of the inkjet head 202 is variable, the stopping time of the inkjet head 202 being after its backward move before it starts a next forward move. The conveyance control unit 264 controls the conveyance mechanism 204 so that a sheet P is conveyed by a predetermined distance in the conveyance direction each time the inkjet head 202 moves forward and backward once in the main scanning direction. The head control unit 263 outputs drive data to the driver IC 51 so that ink is to be ejected through the ejection openings towards a sheet P paused during its conveyance by the conveyance mechanism 204 and while the carriage 205 is moving forward and backward. The driver IC 51 generates ejection signals each having a predetermined frequency same as that of the first ejection signals of the first embodiment, based on drive data output from the head control unit 263. Thus, an image based on the drive data is formed on a sheet P being conveyed by the conveyance mechanism 204.

Assuming that ejection signals are supplied to the inkjet head 202 and the stopping time is a predetermined period of time, the calculation unit 265 sequentially calculates variations in total amount of ink to be ejected through the ejection openings for respective constant periods of time. The calculation is carried out with respect to all the ejection openings provided to the inkjet head 202. In the present embodiment, the calculation unit 265 sequentially calculates variations as a difference between total amount of ink to be ejected through all the ejection openings (total amount of ink to be ejected in one period—total amount of ink to be ejected in the preceding period) in two consecutive periods; i.e., a natural number multiple of a printing cycle. In the present embodiment, one period is longer than a time it takes for the carriage 205 to move the inkjet head 202 forward or backward, and is equal to a time obtained by dividing a 1/n of the length of a sheet P in the conveyance direction by conveyance speed. In other words, the calculation unit 65 calculates n variations ΔV for one sheet. One period is equal to a time it takes the inkjet head 202 to move forward and backward twice, for example.

The prediction unit 266 predicts whether an excess condition occurs, where a pressure difference Pd falls below a threshold value k which is a negative value. As described in the first embodiment, the present inventor perceived that there is a higher possibility that the pressure difference Pd falls below the threshold value k when a predetermined number (first predetermined number) or more of the one or more variations in total amount of ink exceed the predetermined value, the variations being calculated for respective periods. Based on the perception, the prediction unit 266 predicts that the pressure difference Pd falls below the threshold value k when at least one of the n variations ΔV exceeds a predetermined value X2 in the present embodiment, the n variations ΔV being calculated for respective periods W by the calculation unit 265. Here, the period W has such a length where the predetermined number is one, and the predetermined value is X2. In the present embodiment, the predetermined value X2 is determined on the premise that the threshold value k is −2.0 kPa.

The meniscus pressure resistance P decreases as the ink temperature T increases, as described above. The prediction unit 266 includes a table associating the ink temperature T with the predetermined value X2. With reference to the table, the prediction unit 266 decreases the predetermined value X2 as the ink temperature T increases. The predetermined value X2 may be constant regardless of the ink temperature T, as a modification.

When the prediction unit 266 predicts that the pressure difference Pd does not fall below the threshold value k, the carriage control unit 268 supplies a control signal to the drive motor 207, the control signal instructing that a stopping time of the inkjet head 202 is the predetermined period of time. When the prediction unit 266 predicts that the pressure difference Pd falls below the threshold value k, the carriage control unit 268 supplies a control signal to the drive motor 207, the control signal instructing that a stopping time of the inkjet head 202 is longer than the predetermined period of time. When the prediction unit 266 predicts that the pressure difference Pd falls below the threshold value k, the carriage control unit 268 determines, with reference to a result of calculation performed by the calculation unit 265, a stopping time of the inkjet head 202 so that none of the variations in total amount of ink to be ejected for respective periods through the ejection openings exceeds the predetermined value X2, the stopping time of the inkjet head 202 being after a forward movement of the inkjet head 202 before starting a backward movement. The carriage control unit 268 determines the stopping time so that the stopping time increases as the variation ΔV calculated by the calculation unit 265 increases. The relationship between the variation ΔV and the stopping time is stored in the carriage control unit 268 in advance.

Figure 15A:
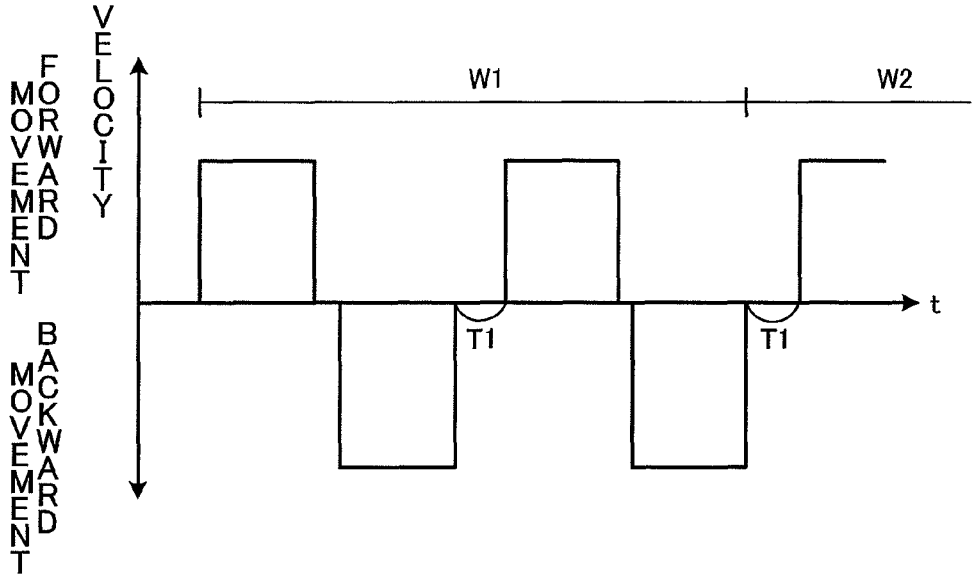
FIGS. 15A and 15B are graphs showing an example of travel speeds of a carriage of the second embodiment of the present invention.
Figure 15B:
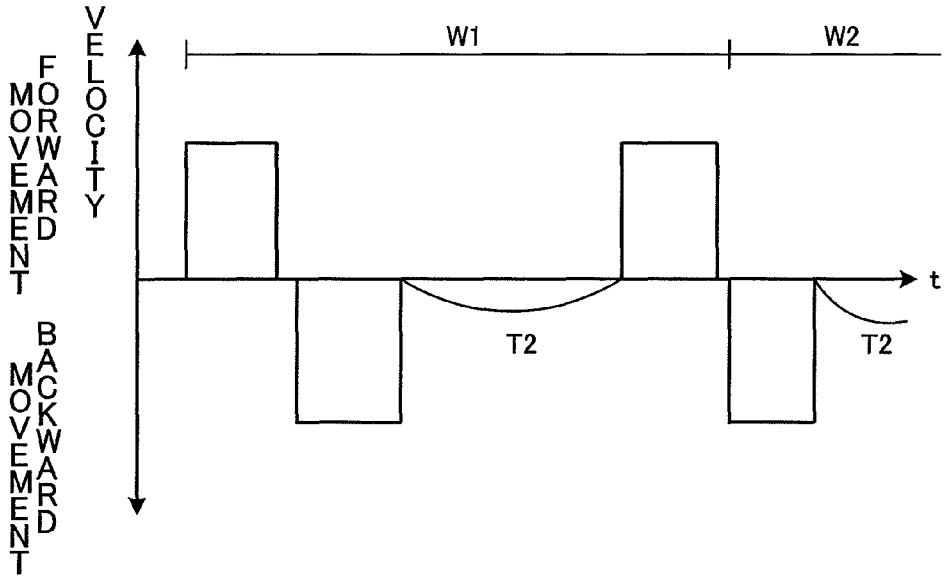

FIG. 15A is a graph illustrating change of speed of the carriage 205 when the stopping time of the inkjet head 202 is a predetermined time T1, which stopping time is after a backward movement of the inkjet head 202 until the inkjet head 202 starts a next forward movement. FIG. 15B is a graph illustrating change of speed of the carriage 205 when the stopping time of the inkjet head 202 is a time T2. Here, the predetermined time T1 is shorter than the time T2 in the present embodiment. This causes the variations in total amount of ink to be ejected within a period W through the ejection openings to decrease to below the predetermined value X2 in any period W (W1, W2, . . . ). Thus, the pressure difference Pd does not fall below the threshold value k, even without larger cross-sectional areas of passages. This accordingly realizes a smaller inkjet head 202 while preventing the meniscus from breaking.

<Modification 6>

In the above second embodiment, a stopping time is changed, which stopping time is after a backward movement of the inkjet head 202 before it starts a next forward movement. However, a stopping time after a forward movement of the inkjet head 2 before it starts a backward movement may be changed. Alternatively, both of the stopping times may be changed. Further, as long as a stopping time is changed within one period, a stopping time may be changed each time the inkjet head 202 makes a forward or backward movement in the main scanning direction for an odd number, at least three times.

<Modification 7>

In the above second embodiment, a stopping time of the inkjet head 202 is variable when the prediction unit 266 predicts that the pressure difference Pd falls below the threshold value k. The stopping time in this case, however, may be a fixed value longer than the predetermined time. In this case, the possibility of the pressure difference Pd not falling below the threshold value k is high even when the stopping time causes at least one of the variations in total amount of ink to exceed the predetermined value X2. This prevents the meniscus from breaking.

<Modification 8>

In the second embodiment, the prediction unit 266 predicts tat the pressure difference Pd falls below the threshold value k when at least one of the n variations ΔV exceeds the predetermined value X2. The prediction unit 266, however, may predict that the pressure difference Pd falls below the threshold value k when two or more of the n variations ΔV exceed the predetermined value X2 (first predetermined value). This is because the standard reference number (first predetermined number) changes in accordance with the length of the period.

<Modification 9>

In the second embodiment, the prediction unit 266 makes prediction only with the n variations ΔV. As in modification 3, the prediction unit 266 may predict that the pressure difference Pd falls below the threshold value k when the first predetermined number or more variations ΔV out of the n variations calculated by the calculation unit 265 exceed the first predetermined value and total amount of ink to be ejected through the ejection openings exceed a second predetermined value for consecutive second predetermined number of periods. The periods about the consecutive second predetermined number begins at a period A which is defined such that the variation ΔV in the period A is equal to or less than the first predetermined value and the variation ΔV in a period B immediately before the period A exceeds the first predetermined value.

<Modification 10>

Yet as another modification, the pressure difference Pd may be sequentially calculated using the variations ΔV for respective constant periods of time, and a prediction may be made by comparing the calculated pressure difference Pd with the threshold value k, as in modification 5. The prediction unit 266, for instance, predicts that the pressure difference Pd falls below the threshold value k when a predetermined number; e.g., one, or more of one or more of the pressure differences Pd calculated fall below the threshold value k. The duration mentioned in modification 3 may be included when calculating the pressure difference Pd from the variations ΔV. A procedure for calculating a pressure difference Pd from variations ΔV is the same as the one described in modification 3. In the present modification, the threshold value k which is a negative value may increase as the ink temperature T detected by the temperature sensor 51*a* increases. Further, the present modification may be applied to modifications 6 and 7.

<Modification 11>

When it is predicted that the pressure difference Pd falls below the threshold value k, the frequency of ejection signals are reduced on the entire sheet P in the first embodiment, and a stopping time of the inkjet head 202 is increased in the entire printing operation to a sheet P in the second embodiment. Nevertheless, the frequency of ejection signals may be reduced, or the stopping time may be increased, only in a period that it is predicted that the pressure difference Pd falls below the threshold value k. This allows a printing process to be completed in a short period of time.

In the second embodiment, the frequency of ejection signals may be changed as in the first embodiment, instead of changing the stopping time. Further, the present invention is applicable to a recording apparatus which ejects liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a recording head provided with a plurality of ejection openings each ejecting a liquid droplet;

a movement mechanism which moves a recording medium relative to the recording head;

a storage which stores drive data indicating an amount of liquid to be ejected in each recording cycle through each of the ejection openings;

a first ejection signal generator which generates, based on the drive data stored in the storage, first ejection signals each having a first frequency;

a calculator which calculates, assuming that first ejection signals are supplied to the recording head, variations in total amount of liquid to be ejected through the ejection openings, for respective constant periods of time;

a predictor which predicts, based on one or more variations calculated by the calculator, whether a pressure difference between the atmosphere and liquid sandwiching a meniscus falls below a threshold value during recording on a recording medium by the recording head to which the first ejection signals are supplied, the meniscus being formed in one of the ejection openings;

a second ejection signal generator which generates, based on the drive data stored in the storage, second ejection signals each having a second frequency lower than the first frequency;

a head controller which controls signal supply to the recording head, so that the first ejection signals are supplied to the recording head when the predictor predicts that the pressure difference does not fall below the threshold value, and the second ejection signals are supplied to the recording head when the predictor predicts that the pressure difference falls below the threshold value; and a movement controller which controls the movement mechanism so that a recording medium moves relative to the recording head at a speed corresponding to a frequency supplied to the recording head out of the first and the second frequencies.

2. The recording apparatus according to claim 1, wherein the predictor predicts that the pressure difference falls below the threshold value when a first predetermined number or more of the one or more variations calculated by the calculator exceed a first predetermined value.

3. The recording apparatus according to claim 2, wherein the head controller determines the second frequency so that fewer than the first predetermined number of the one or more variations in total amount of liquid to be ejected through the ejection openings for respective periods exceed the first predetermined value, assuming that the second ejection signals are supplied to the recording head.

4. The recording apparatus according to claim 2, wherein the predictor predicts that the pressure difference falls below the threshold value when the first predetermined number or more variations out of the one or more variations calculated by the calculator exceed the first predetermined value and total amount of liquid to be ejected through the ejection openings exceed a second predetermined value for consecutive second predetermined number of periods, the periods beginning at a period A which is defined such that the variation in the period A is equal to or less than the first predetermined value and the variation in a period B immediately before the period A exceeds the first predetermined value.

5. The recording apparatus according to claim 2, wherein the predictor predicts, when at least one of the one or more variations calculated by the calculator exceeds the first predetermined value, that the pressure difference falls below the threshold value.

6. The recording apparatus according to claim 2, wherein the recording head includes a plurality of common liquid passages each temporarily stores liquid supplied from outside, and a plurality of individual liquid passages each running from an exit of one of the common liquid passages through a pressure chamber to one of the ejection openings, assuming that first ejection signals are supplied to the recording head, the calculator calculates for respective periods, with respect to each common liquid passage, the variations in total amount of liquid to be ejected through the ejection openings connected to the common liquid passage, and the predictor predicts, when at least one of the one or more variations exceeds the first predetermined value, that the pressure difference falls below the threshold value, the one or more variations being calculated by the calculator with respect to each common liquid passage.

7. The recording apparatus according to claim 2, wherein the drive data stored in the storage indicates that each of the ejection openings ejects in each recording cycle any one of a plurality of different amounts of liquid, and the first predetermined value is determined on a premise that the threshold value is less than the pressure difference and exceeds a pressure resistance of the meniscus, which pressure difference is of a case where a total amount of liquid to be ejected through the ejection openings and a total amount of liquid to be supplied to the ejection openings balance each other out, when the drive data indicates that the ejection openings each consecutively eject a maximum amount of liquid among the plurality of different amounts of liquid.

8. The recording apparatus according to claim 2, further comprising a temperature detector which detect a temperature of liquid inside the recording head, wherein the predictor decreases the first predetermined value as the temperature detected by the temperature detector increases.

9. The recording apparatus according to claim 1, wherein the predictor calculates pressure differences with the one or more variations calculated by the calculator, and makes a prediction based on whether a predetermined number or more of one or more pressure differences calculated falls below the threshold value.

10. The recording apparatus according to claim 9, wherein the predictor calculates the pressure differences with the one or more variations calculated by the calculator and the number of periods, beginning at a period C which is defined such that the variation in the period C is equal to or less than a third predetermined value and the variation in a period D immediately before the period C exceeds the third predetermined value, in which a fourth predetermined value or more total amount of liquid is to be consecutively ejected through the ejection openings.

11. The recording apparatus according to claim 1, wherein the movement mechanism is a conveyance mechanism which moves a recording medium in a direction of the relative movement, and the recording head is a line recording head where the plurality of ejection openings are aligned at equal intervals in a direction perpendicular to a direction in which a recording medium is conveyed by the conveyance mechanism, and the recording head is fixed with respect to the perpendicular direction.

* * * * *